US009789602B2

(12) United States Patent
DeBaker

(10) Patent No.: US 9,789,602 B2
(45) Date of Patent: Oct. 17, 2017

(54) BICYCLE REPAIR STAND

(71) Applicant: Saris Cycling Group, Inc., Madison, WI (US)

(72) Inventor: Chad DeBaker, Minneapolis, MN (US)

(73) Assignee: Saris Cycling Group, Inc., Madison, WI (US)

( * ) Notice: Subject to any disclaimer, the term of this patent is extended or adjusted under 35 U.S.C. 154(b) by 0 days.

(21) Appl. No.: 14/690,162

(22) Filed: Apr. 17, 2015

(65) Prior Publication Data

US 2015/0298314 A1 Oct. 22, 2015

Related U.S. Application Data

(60) Provisional application No. 61/995,673, filed on Apr. 17, 2014.

(51) Int. Cl.

| | |
|---|---|
| ***B25H 5/00*** | (2006.01) |
| ***B25H 1/00*** | (2006.01) |
| ***F04B 33/00*** | (2006.01) |

(52) U.S. Cl.

CPC ..... *B25H 5/00* (2013.01); *B25H 1/0014* (2013.01); *F04B 33/005* (2013.01)

(58) Field of Classification Search

CPC ..... B25H 1/0014; B25H 5/00

USPC ..... D12/115

See application file for complete search history.

(56) References Cited

U.S. PATENT DOCUMENTS

| | | | | | |
|---|---|---|---|---|---|
| 2,438,515 | A * | 3/1948 | Mohler | H04M 5/02 | 174/69 |
| 4,170,307 | A * | 10/1979 | Maeder | B25H 1/0014 | 211/163 |
| 4,759,560 | A * | 7/1988 | Virgulti | B25H 3/00 | 180/53.8 |
| 5,842,581 | A * | 12/1998 | Graefe | B62H 3/00 | 211/119.004 |
| D680,914 | S * | 4/2013 | Greenblatt | D12/115 | |
| D717,214 | S * | 11/2014 | Greenblatt | D12/115 | |
| 2005/0023431 | A1* | 2/2005 | Coffelt | G07F 17/00 | 248/637 |
| 2005/0276670 | A1* | 12/2005 | Freund | B25H 1/0035 | 408/129 |
| 2011/0233350 | A1* | 9/2011 | Burgess | F16M 11/04 | 248/123.11 |
| 2013/0219705 | A1* | 8/2013 | Scholtz | B25H 1/0014 | 29/650 |
| 2014/0263880 | A1* | 9/2014 | Greenblatt | B25H 5/00 | 248/121 |

FOREIGN PATENT DOCUMENTS

| | | | |
|---|---|---|---|
| DE | 19928978 | * 12/2000 | B25H 5/00 |
| DE | 102013016853 | * 12/2014 | B25H 5/00 |

* cited by examiner

*Primary Examiner* — Michael Safavi

(74) *Attorney, Agent, or Firm* — Boyle Fredrickson, S.C.

(57) ABSTRACT

A bicycle repair stand includes an upright column. A first repair station includes a repair rack extending from the upright column in a first direction. The repair rack retains a bicycle at an elevated position relative to a column base. A tool storage face is provided along an exterior of the upright column. At least one retractable tool is coupled along the tool storage face. The at least one retractable tool includes a tool, a cable coupled with the tool, and a retraction mechanism coupled with the cable and configured to pull the tool toward the tool storage face when released by an operator.

28 Claims, 10 Drawing Sheets

BICYCLE REPAIR STAND

CLAIM OF PRIORITY

This application claims the benefit of priority of U.S. Provisional Patent Application Ser. No. 61/995,673, filed on Apr. 17, 2014, which is herein incorporated by reference in its entirety.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright Bike Fixtation, Minneapolis, Minn. All Rights Reserved.

TECHNICAL FIELD

This document pertains generally, but not by way of limitation, to repair stands for bicycles.

BACKGROUND

Bicycle repair stands are found along roads, paths and the like and provide a station to examine and repair a bicycle. In some examples, the stands include an elevated rack for the bicycle and one or more tools coupled with the stand. The tools are used by a rider to repair the bicycle. For instance, the stand includes tools sufficient for changing a flat tire, inflating a tire, adjusting brakes and derailleurs, or the like.

In some examples the tools are coupled with the stand using one or more tethers that allow the tools to rest at the end of the tethers. The tools are loosely positioned around the stand. The tools are grasped and released as needed by the rider during repairs on a bicycle.

In other examples, the tools are retained within a cavity of the stand. The tools are grasped and pulled from the cavity, for instance while coupled with tethers within the cavity.

OVERVIEW

The present inventors have recognized, among other things, that a problem to be solved can include organizing and maintaining tools for a bicycle repair stand while maintaining exterior accessibility of the tools. For instance, tools tethered to a bicycle stand are free to hang from the bicycle stand and accordingly tangle through one or more of repeated use or environmental conditions including wind. The tangled tethers and the corresponding tools are difficult to use. Additionally, the tethered tools are prone to striking the repair stand. Repeated striking damages one or more of the finish of the repair stand or the tools. In another example, where the tools are retained within a cavity of a repair stand the tools are difficult to observe (especially in sunny weather) and require interior grasping and manipulation to select and pull the tools from the cavity.

In an example, the present subject matter can provide a solution to this problem, such as by providing a bicycle repair stand having one or more tools coupled by cables with an upright column of the repair station. Each of the one or more tools is coupled with a retraction mechanism with the cable. In one example, the refraction mechanism includes a counterweight coupled with the cable and positioned within the upright column. The rider grasps a tool from an exterior tool storage face of the upright column for use in a bicycle repair. The tool is released when the repair is finished and the retraction mechanism pulls the cable and tool to the tool storage face along the upright column exterior. The retraction mechanism ensures that the slack of the cable is pulled into the upright column, and accordingly prevented from tangling. Optionally, the upright column includes dedicated channels for each of the counterweights and cables to ensure the counterweights and cables do not tangle within the column.

The retractable tools (tools coupled with a refraction mechanism) are positioned along the tool storage face to store and arrange the tools at an exterior location of the upright column. For instance near an upper end of the upright column. The tool storage face is in one example one of a plurality of faces of the upright column. The faces are recessed away from the repair rack. For instance, the faces including the tool storage face are directed in differing directions relative to the repair rack (and positioned along an exterior face of the upright column) to facilitate easy access to the tools for the rider.

In another option, a tool shield is coupled along the tool storage face. The tool shield is in one example a polymer and configured to absorb the force of tool strikes against the upright column, for instance as the retraction mechanism pulls a tool toward the tool storage face, or inadvertent strikes from a bicycle, such as from the bicycle pedals.

Optionally, the bicycle repair stand includes a second repair station. In one example, the second repair station extends in a direction away from the repair rack, and thereby facilitates the positioning of a second bicycle at the bicycle repair stand. The second repair station includes a wheel chock that maintains the second bicycle in an upright configuration near a column base of the upright column. Optionally, the bicycle repair stand includes an air pump. The air pump includes a hose extending from the upright column and configured to reach bicycles on the repair rack as well as at the second repair station. An air line extends within the upright column from the air pump to a hose fitting. The hose extends from the hose fitting (e.g., at an upper end of the upright column). The hose hangs from the upright column. Because the remainder of the tools are stored along the tool storage face and the cables are retained within the upright column, the hose for the air pump hangs freely and without tangling.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. The drawings illustrate generally, by way of example, but not by way of limitation, various embodiments discussed in the present document.

DETAILED DESCRIPTION

Figure 1:
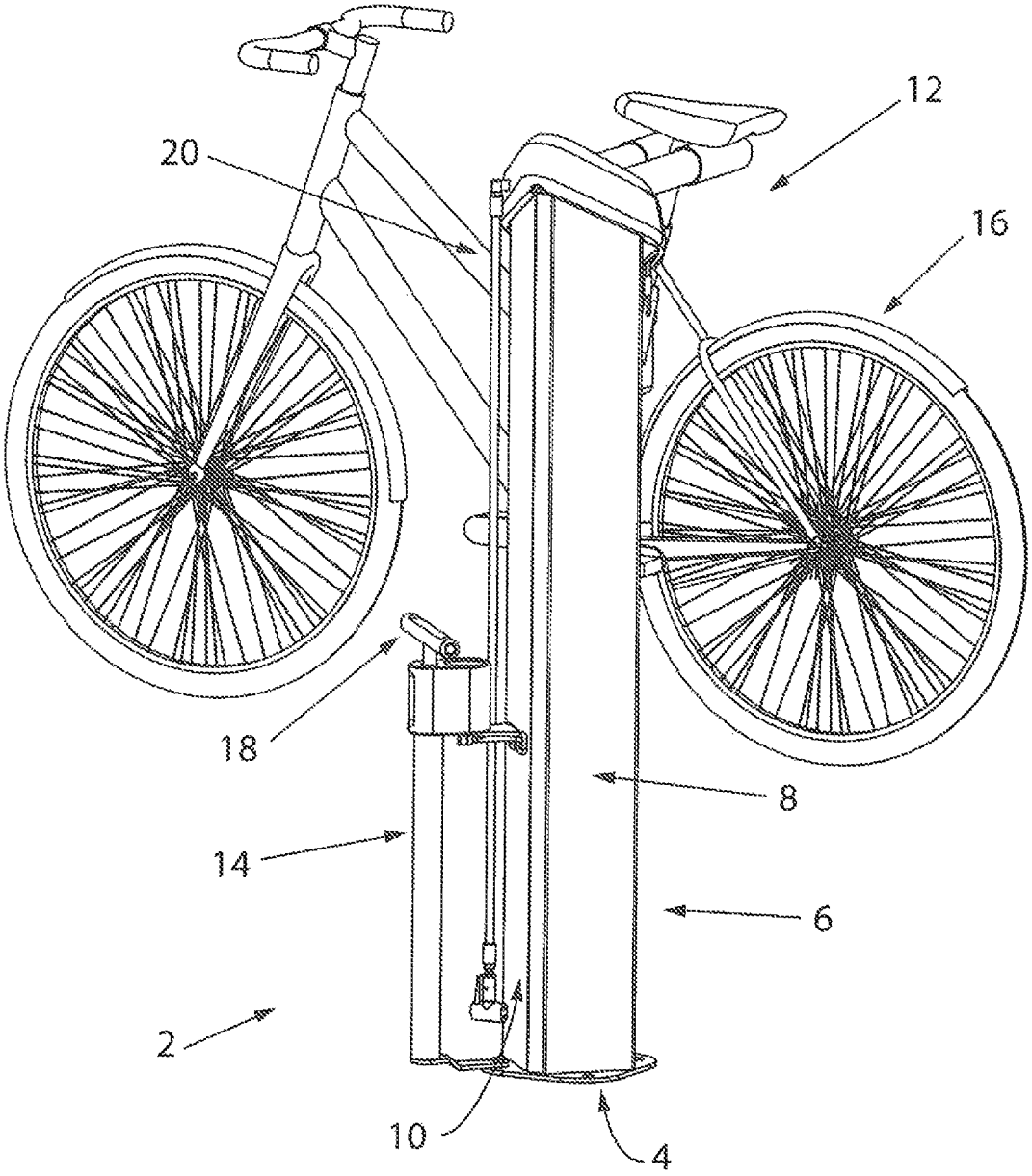
FIG. 1 is a perspective view of one example of a bicycle repair stand.

FIG. 1 shows one example of a bicycle repair stand 2 including an upright column 6 having a column base 4 configured to be in contact with a surface, such as the ground. In an example, the column base 4 is coupled with the surface, such as with one or more fasteners, including, but not limited to, bolts, screws, concrete fasteners (e.g., tap cons), or the like. The upright column 6, in various examples, is from about 3 feet in height to about 7 feet in height. In another example, the height of the upright column 6 is adjustable according to a user preference or preference at installation.

As shown, the upright column 6 includes two or more exterior column faces, including a first column face 8 and a second column face 10. In an example, the upright column 6 has a geometric cross-section such as a triangle, square, rectangle, polygonal shape, or the like. Optionally, one or more of the column faces 8, 10 includes a coating (e.g., shield), such as a polymer coating, configured to protect the upright column 6 from chipping, scratches or the like, for instance from tools, impact by the bicycle 16 or the like. As shown in FIG. 1, one or more of the plurality of column faces 8, 10 includes a graphic, such as a marketing advertisement, branding, a map, bicycle repair station instructions, municipal contact information, or the like. In another example, the bicycle repair stand 2 includes an emergency phone or emergency alert system (e.g., alarm, light or the like) for one or more of contacting an emergency service or providing an alert to assist in calling for help. The bicycle repair stand 2, in an example, includes a light, such as an area light to illuminate the bicycle repair stand 2.

As shown in FIG. 1, the bicycle repair stand 2 includes a first repair station 12. The first repair station 12 includes a repair rack configured to support a bicycle 16, as will be discussed herein. In one example, the rack suspends the bicycle 6 at an elevated position to facilitate repair of the bicycle by a user. As further shown in FIG. 1 the bicycle repair stand 2 optionally includes an air pump assembly 14 having an air pump 18 coupled to the upright column 6 and a hose 20 configured to extend from the upright column 6. In another example, the air pump assembly 14 includes an air compressor or other pneumatic system that provides a source of compressed air to the hose 20 to facilitate filling of bicycle tires.

Figure 2:
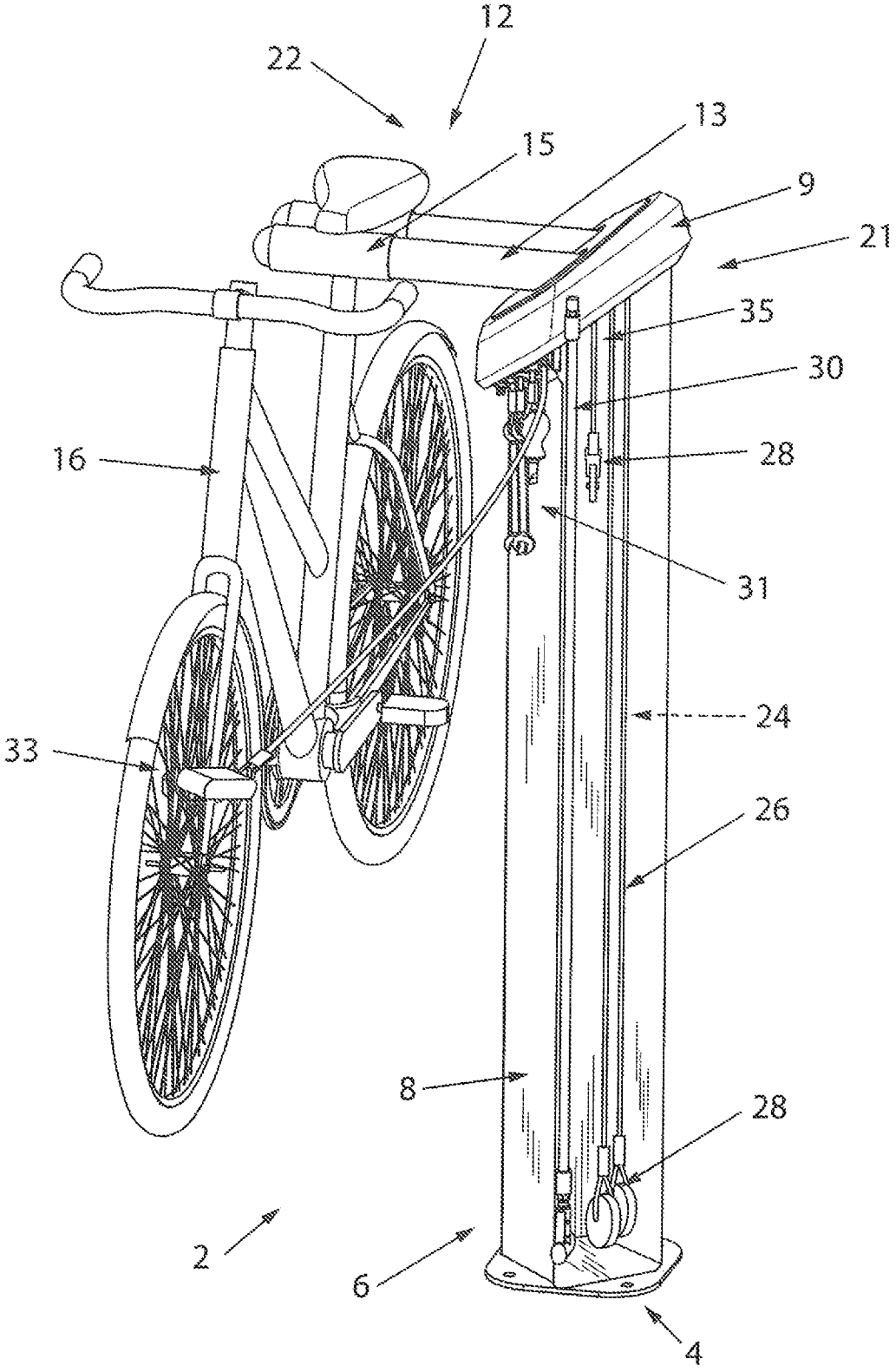
FIG. 2 is a perspective view of one example of a bicycle repair stand.

FIG. 2 shows the bicycle repair stand 2 from a different perspective with a portion of the upright column 6 removed. The bicycle repair stand 2 includes the first repair station 12 and at least one retractable tool 30. In an example, the first repair station 12 includes a repair rack 22 extending from the upright column 6 in a first direction, such as away from the upright column 6. As discussed herein, the repair rack 22 includes, in an example, at least one rod 13 including a rack fitting 15 coupled thereto. The repair rack 22, in an example, is configured to retain the bicycle 16 at an elevated position relative to the column base 4 (e.g., for ease of access to the bicycle components). The repair rack 22 extends from an upper end portion 21 of the upright column 6 or at a corner (e.g., intersection) of two of the plurality of column faces 8, 10. With the repair rack 22 extending from the corner of two of the column faces 8, 10 the user has ready access to a plurality of tools 30 provided along each of the faces 8, 10 for use with the bicycle 16. Stated another way, the tools 30 are provided on surfaces directed generally toward the bicycle and also at an angle to provide space to access and use the tools.

At least one of the column faces 8, 10 is a tool storage face directed in a second direction different than the first direction in which the repair rack 22 extends from the upright column 6. The tool storage face 8 (e.g., one of the column faces) in an example, is recessed from the bicycle 16 when the bicycle is in the elevated position on the repair rack 22. The at least one retractable tool 30 is stored along the tool storage face 8 at the upper end portion 21 of the upright column 6. In an example, the top portion 21 of the upright column 6 includes a cap 9 that overhangs the at least one retractable tool 30. For example, the cap 9 provides cover to the at least one retractable tool 30 from the elements including, but not limited to, rain, snow, sleet, hail, accumulating ice or the like.

In the example shown in FIG. 2, the at least one retractable tool 30 is coupled with the bicycle repair stand 2 with a tether maintains the tool 30 in contact with the stand 2 (e.g., prevents removal) and also couples the tool with a retraction mechanism that pulls a replaced tool 30 toward a stowed position, for instance near the upper end portion 21 (and optionally under the cover of the cap 9), as previously described herein. In one example, each retractable tool 30 includes a cable 26 (e.g., a tether, lanyard, line or the like) coupled to the tool body 33 and a retraction mechanism, such as a counterweight 28, coupled to the cable 26. The counterweight 28, by way of the cable 26, pulls the retractable tool 30 toward the storage face 8 when the tool 30 is released by an operator. The counterweight 28, in an example, is stored within an interior 24 of the upright column 6 pulls the tool 30 toward the storage face 8 while descending within the interior 24 of the upright column 6. As shown in FIG. 2, the upright column 6 has the interior 24 exposed to the outside environment; however examples are not so limited. In an example, the upright column 6 is an enclosed structure with the interior 24 not exposed to the environment.

In an example, the counterweight 28 has a tapered shape at one or more of a lower end or an upper end. Optionally, the upright column 6 includes one or more retraction channels (see FIG. 8) associated with each of the one or more retractable tools 30. The one or more retraction channels isolate each of the cables 26 and associated counterweights 28 from one another, such as when the retractable tools 30 are at rest or the counterweights are ascending or descending within the interior 24 of the upright column 6. The retraction channels ensure the cables 26 do not tangle or interfere with each other and accordingly allow each of the retractable tools 30 to operate (e.g., descend and ascend) relative to each other in a consistent manner. In another example, the cables 26 and counterweights are collectively received within the cavity of the upright column 6 and are spaced from each other to minimize tangling and interference. In still another example, the cables 26 are provided over pulleys to guide ascent and descent of the cables 26 and counterweights 28 to minimize tangling and interference.

In an example, the at least one retractable tool 30 includes a locking mechanism 35 configured to prevent the cable 26 from retracting into the interior 24 of the upright column 6. The locking mechanism 35 (e.g., resettable ratchet, releasable clamp or the like) maintains a length of cable 26 in a deployed position (relative to the column 6) and offsets the pull otherwise provided by the counterweight 28 (or another example of a retraction mechanism). Stated another way, the locking mechanism 35 permits an operator to prevent the counterweight 28 from lowering and pulling the tool 30 toward the tool storage surface 8, for instance while using the retractable tool for maintenance.

In another example, the counterweight 28 is exchanged for another retraction mechanism including, but not limited to, a spring loaded pulley system, elastomeric cables 26 or the like. The retraction mechanism in any of a number of forms (counterweight, pulleys, elastomeric cables or the like) operates to pull the cable 26 and the associated retractable tool 30 into the stowed position shown for instance in FIG. 4.

As previously described herein, the tool storage surface 8 includes a tool shield 31, such as a polymer coating or guard, extending along at least a portion of the tool storage surface 8. The tool shield 31 protects the upright column 6 from damage caused by the one or more tools 30 striking the upright column 6, including the tool storage surface 8. The tool shield 31 further minimizes incidental damage caused by a bicycle being mounted or dismounted from the repair rack 22. In still another example, the tool shield 31 includes a hardened coating provided over at least a portion of the upright column 6.

Figure 3:
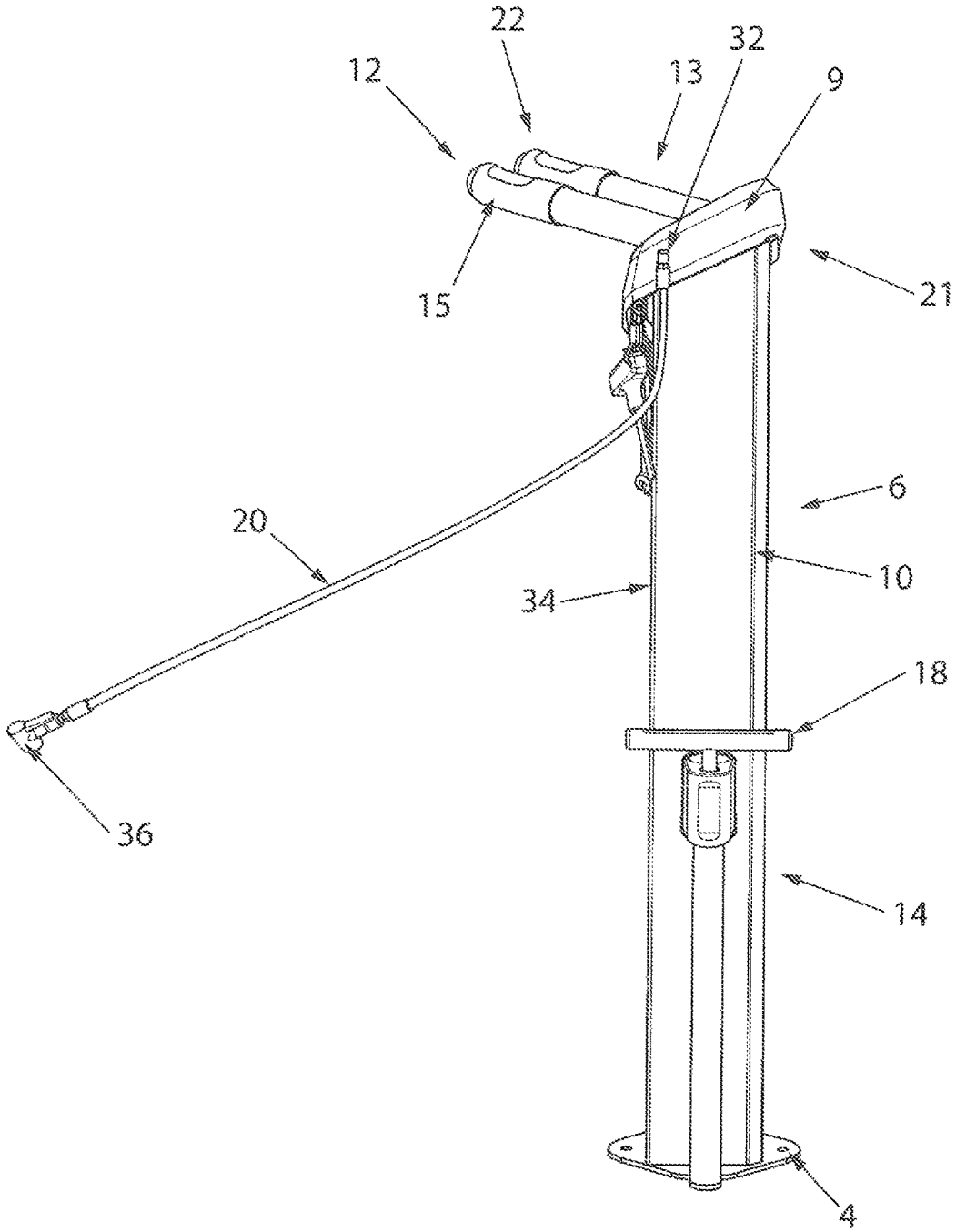
FIG. 3 is a perspective view of one example of a bicycle repair stand.

FIG. 3 shows bicycle repair stand 2 with the air pump assembly 14 includes the air pump 18 coupled with the upright column 6. In an example, the air pump assembly 14 includes an air line 34 extending from the air pump 18 near the column base 4 and along the upright column 6, such as on the column surface 10 or within the interior 24 (e.g., see FIG. 2) of the upright column 6. The air line 34 extends to a hose fitting 32 remote from the column base 4 (e.g., near the upper end portion 21 of the upright column 6). A hose 20 is communicatively coupled to the hose fitting 32. When an operator uses the air pump 18 a feature of the hose 20 is grasped, such as the hose connection 36, and coupled with a nipple or port of a bicycle tire. Operation of the air pump 18 forces air through the air line 34, the hose fitting 32, and through the hose 20, and finally to the hose connection 36 and tire. As discussed herein, in an example the air pump 18 is exchanged for another source of pressurized gas including an air compressor, pneumatic system or the like.

In an example, the hose 20 is configured to have a length such that the hose 20 hangs from the hose fitting 32 and is suspended above the column base 4 (e.g., the hose 20 does not touch the ground when released by an operator). The hose connection 36 at an end of the hose 20 relative to the hose connection 32 is compatible with at least one of a Presta valve, a Presta with an adapter valve, and a Schrader valve.

Figure 4:
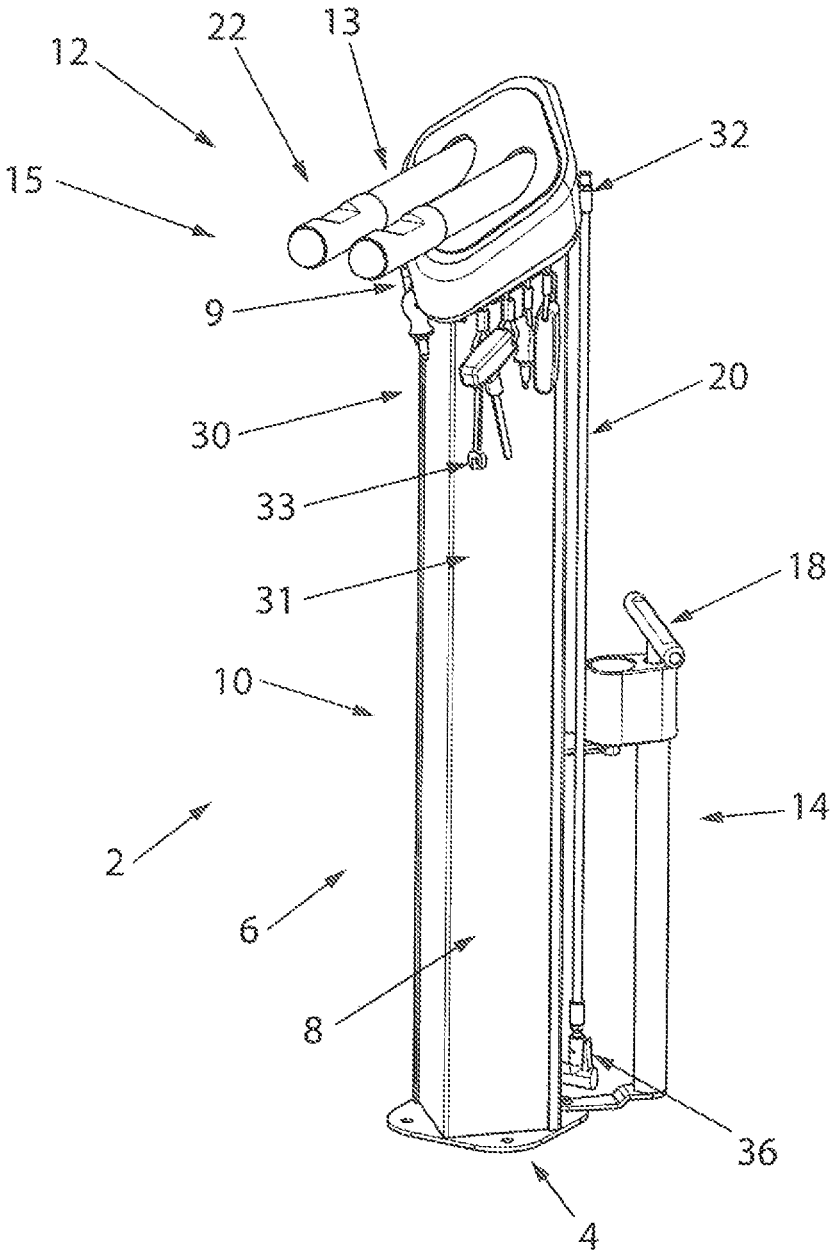
FIG. 4 is a perspective view of one example of a bicycle repair stand.

FIG. 4 shows one example of the bicycle repair stand 2 with a plurality of retractable tools 30 in a stored position along the at least one column face (e.g. one of first or second column faces 8, 10). The plurality of tools 30 are located below the cap 9 toward the upper end portion 21 in the example shown. As shown in FIG. 4, the plurality of tools 30 include, but are not limited to, at least one of a wrench, a spoke wrench, a tire seater, a chain checker, one or more torx keys, a chain tool, a tire lever, a cable cutter, scissors, one or more hex keys, a screwdriver, a combination multi-tool, differing sizes of the same tools, or other bicycle tools. FIG. 4 further shows the repair rack 22. As described in further detail herein, the repair rack 22 includes, in an example, a rack fitting 15 coupled to each rod 13. As further shown, the repair rack 22 is located at the corner of the first column face 8 (e.g., tool storage face) and the second column face 10. The tool shield 31 is also shown in FIG. 4 extending along at least two column faces, such as the column faces 8, 10.

Figure 5:
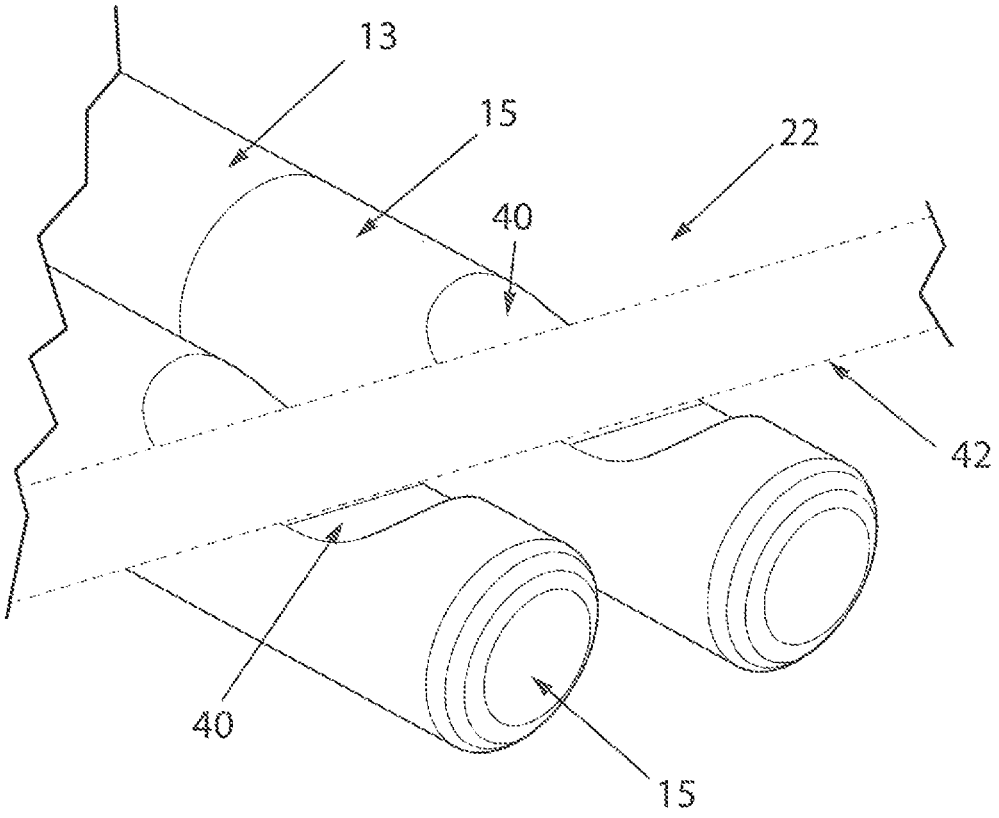
FIG. 5 is a perspective view of one example of a repair rack of a bicycle repair stand.

Referring now to FIG. 5, one example of the repair rack 22 is shown. In this example, the repair rack 22 includes two rods 13. The rods 13 extend from the upright column 6 as described herein. In an example, each of the rods 13 is fitted with rack fittings 15. In one example, the rack fittings 15 are machined plastic or rubber fittings sized and shaped for reception in the rods 13. Each rack fitting 15 provides an elastomeric surface suitable for resting or placing a bicycle frame 42 or a bicycle seat on the repair rack 22. That is, each rack fitting 15 provides a substantially abrasive free surface to place the bicycle frame 41 on the repair rack 22. Optionally, the rack linings 15 provide a tacky rubberized surface to reliably hold the bicycle frame 42 in place while on the repair rack 22. In an example, one or more of the rack fittings 15 or the rods 13 include recesses 40 that further stabilize the bicycle (e.g., FIG. 1, 16) by providing surface to surface contact between the bicycle frame 42 and the repair rack 22. Stated another way, the recesses 40 extend around portions of the bicycle frame 42 while the frame is seated therein.

Figure 6:
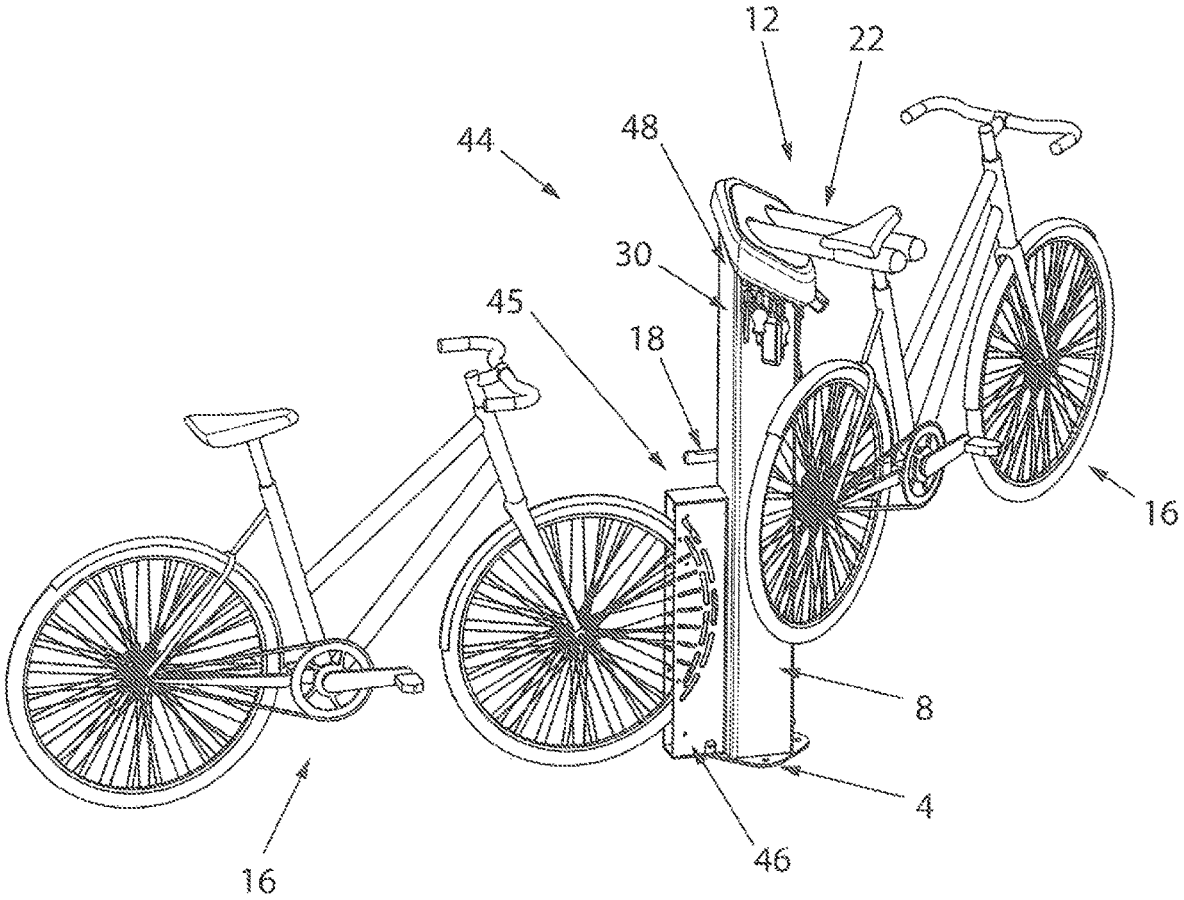
FIG. 6 is a perspective view of one example of a bicycle repair stand for multiple bicycles.

FIG. 6 is a perspective view of another example of a bicycle repair stand 44 configured for coupling with multiple bicycles 16. The bicycle repair stand 44 includes at least some features similar to features of the bicycle repair stand 2. For instance, the bicycle repair stand 44 includes the repair rack 22 and a plurality of retractable tools 30 stored on the tool storage surface 8. The bicycle repair stand 44 includes a second repair station 45 extending in another direction (e.g., a third direction) different than the first direction of the first repair station 12. The second repair station 45, in an example, retains a bicycle 16 at a second (lower) position different than the elevated position of the first repair station 12, as shown. For example, the second repair station 45 includes a wheel chock 46 sized and shaped to receive a wheel of a bicycle and retain the bicycle in an upright orientation at the second position. In an example, the second repair station 45 is located on a third column face 48 different than the column faces 8, 10, discussed herein.

In an example, the column faces 8, 10 of the bicycle repair stand 2 are tilted relative to the repair rack 22 and the wheel chock 46 so as to provide more exposure of the column faces 8, 10 and permit easier access to the column faces 8, 10 for reaching the plurality of retractable tools 30. That is to say, the column faces 8, 10, and 48 are at an angle relative to the direction each of the wheel chock 46 and repair rack 22 extend from the upright column 6. The angling (e.g., canting or tilting) of the faces 8, 10, 48 recesses the faces from the repair rack 22 and the wheel chock 46, for instance to provide room to access the retractable tools 30, the air pump assembly 14 or the like.

Figure 7:
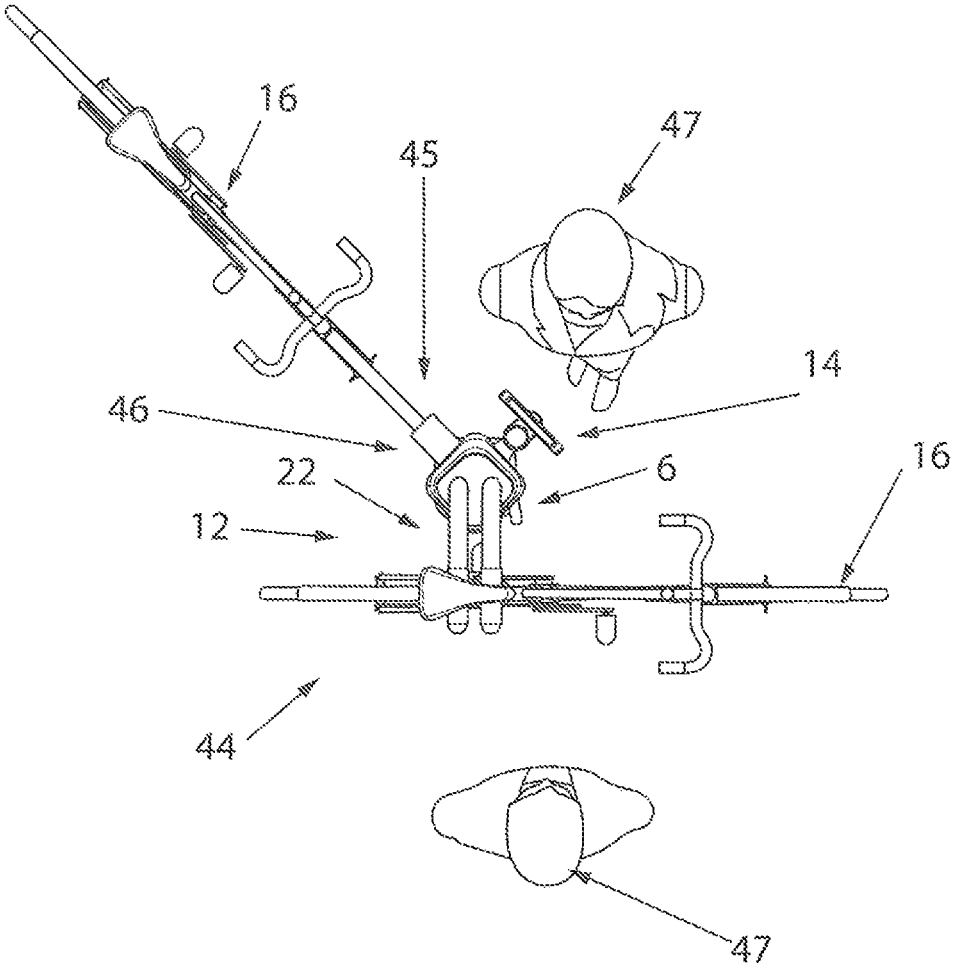
FIG. 7 is a perspective view of one example of a bicycle repair stand for multiple bicycles.

FIG. 7 is a top perspective view of one example of the bicycle repair stand 45 with multiple bicycles 16 coupled with the stand. As shown, the first repair station 12 and the second repair station 45 are positioned relative to each other, the air pump assembly 14, and the retractable tools 30 (as shown in FIGS. 4 and 6) to permit access to both bicycles 16 for repairs, inflating of tires and the like. As shown in FIG. 7, the air pump assembly 14 is positioned approximately 45 degrees relative to a plane of the bicycle 16 coupled with the first repair station 12. The air pump assembly 14 is positioned near the front wheel of the bicycle 16 in the second repair station 45. The user 47 is thereby able operate the air pump 18 without either bicycle 16 interfering. Further, positioning the air pump assembly 14 near the front wheel of the bicycle 16 in the second repair station 45 reduces the overall footprint of the bicycle repair stand.

Figure 8:
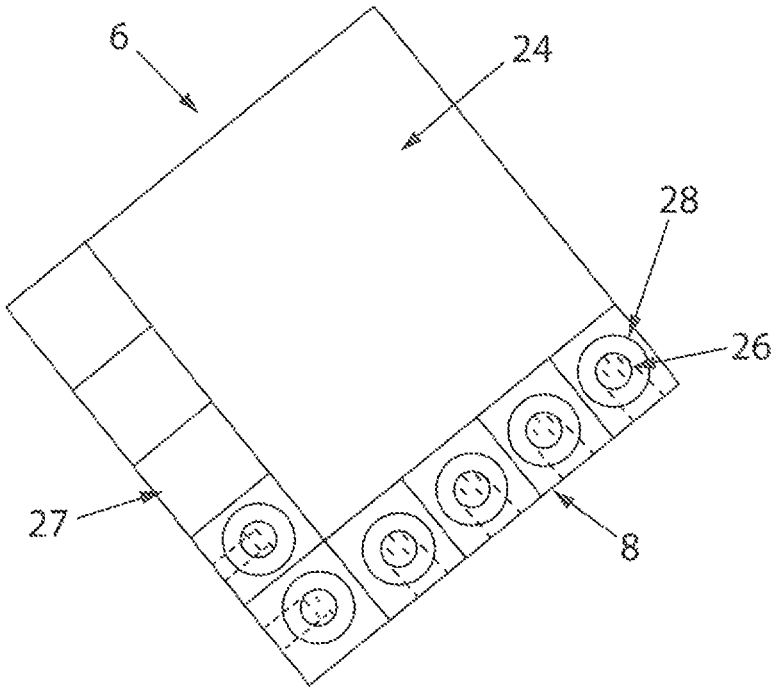
FIG. 8 is a top down view of one example of a bicycle repair stand including retraction channels.

FIG. 8 is atop down cross sectional view of one example of a bicycle repair stand including retraction channels 27. The retraction channels 27 isolate each cable 26 when withdrawn, resting, or being pulled along the interior 24 of the upright column 6. That is, the cable 26 and the respective counterweight 28 move within the respective retraction channel 27 without intercepting other cables or counterweights to minimize tangling and interference. The retraction channels 27, in an example, extend substantially the interior length of the upright column 6. Optionally, the retraction channels extend along a portion of the length of the upright column 6. The outer diameter of the counterweight 28 is less than a diameter of the associated retraction channel 27 to facilitate sliding with the channel. In another example, the retraction channels 27 confine the cable 26 and the outer diameter of the counterweight 28 is greater than the diameter of the retraction channel 27 to affirmatively hold the counterweights 28 within the upright column 6 (e.g., to prevent removal of tools 30, cables 26 or the like).

Optionally, the counterweights 28 are sized (e.g., by weight) to correspond to a particular retractable tool coupled to the opposed end of the associated cable 26. For example, the counterweight 28 associated with a cloth weighs less than the counterweight 28 associated with pliers. Further, in another example, the cable 26 is selected based on the coupled retractable tool 30. For example, heavier retractable tools 30 are coupled to thicker cables 26.

Figure 9:
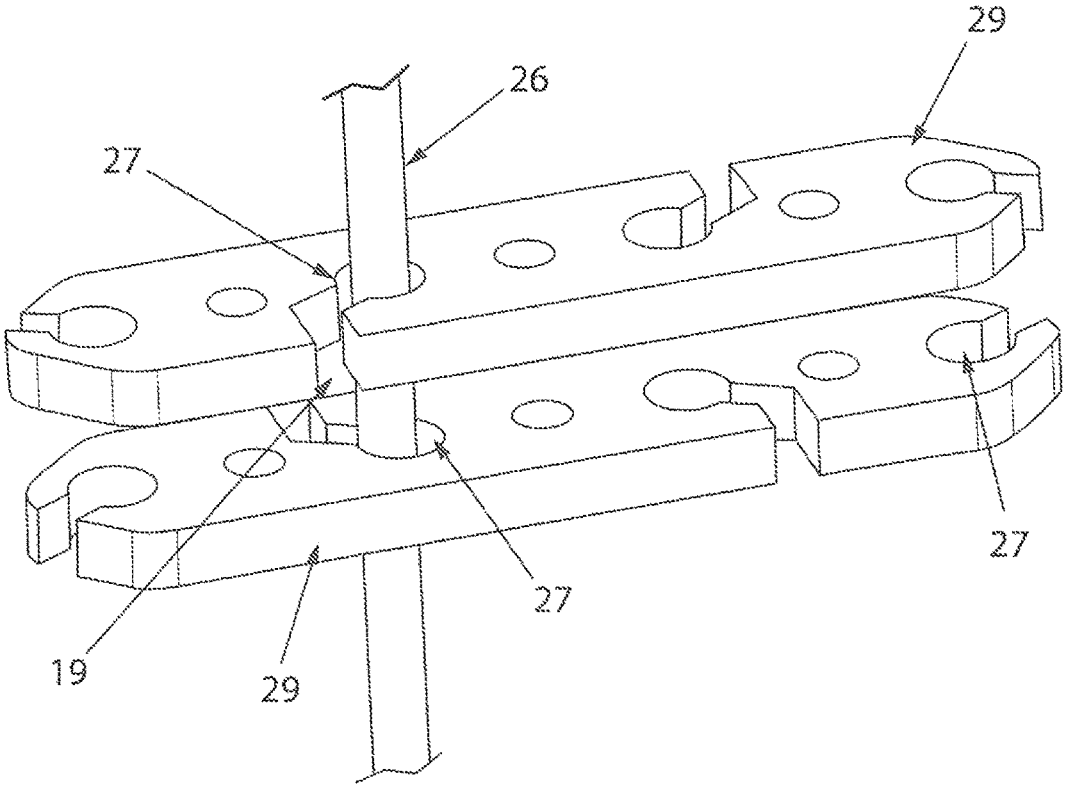
FIG. 9 is a perspective view of one example of a cable guide including a retraction channel of a bicycle repair stand.

FIG. 9 is a perspective view of one example of cable guides 29 each including a plurality of retraction channels 27, as described herein. In an example, an upright column (e.g., FIG. 1, 6) includes at least two cable guides 29 in the interior (e.g., FIG. 1, 24) of the upright column, such as on the respective interior side of the tool storage face (e.g., FIG. 2, 8). Each retraction channel 27 of the cable guide 29 includes a narrow passage 19 for snapping or feeding the cable 26 into the retraction channel 27. The narrow passage 19, for example, acts as a retention mechanism for keeping the cable 26 within the retraction channel 27. The cable 26 has a permanent crimp on each end of the cable 26; a first end permanently crimped to a tool body (e.g., FIG. 2, 33) and a second end permanently crimped to a counterweight (e.g., FIG. 2, 28). The cable guide 29 permits the cable 26, having two permanently crimped ends, to be replaced. In example, the cable 26 is replaced due to a damaged tool body, a damager counterweight, or to switch out a current retractable tool (e.g., FIG. 2, 30) with a more desirable retractable tool.

Figure 10:
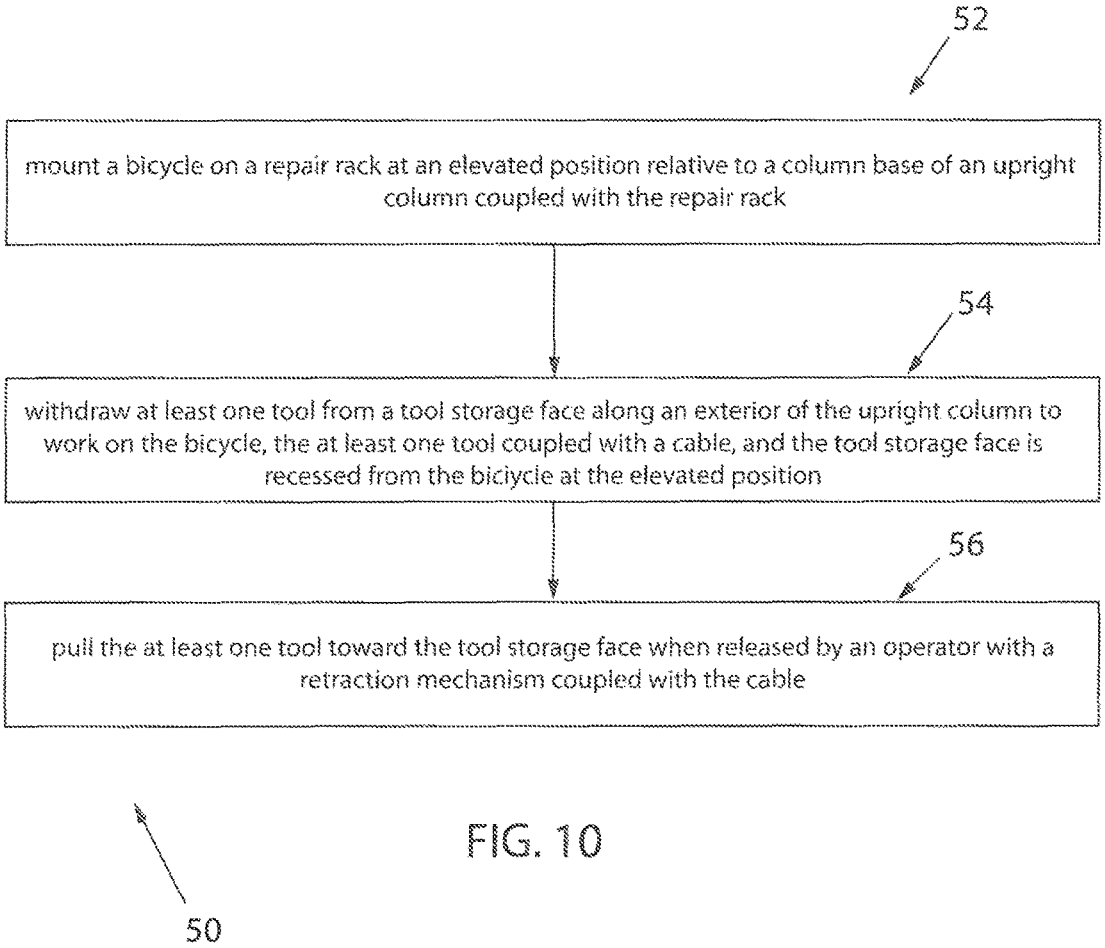
FIG. 10 is a block diagram showing one example of a method for using a bicycle repair stand.

FIG. 10 is a block diagram showing one example of a method 50 for using a bicycle repair stand (e.g., FIG. 1, 2). At 52, the method 50 includes mounting a bicycle (e.g., FIG. 1, 16) on a repair rack (e.g., FIG. 2, 22) at an elevated position relative to a column base (e.g., FIG. 1, 4) of an upright column (e.g., FIG. 1, 6) coupled with the repair rack. In an example, mounting the bicycle on the repair rack includes receiving a portion of the bicycle frame (e.g., FIG. 5, 42) or the bicycle seat within a bicycle support recess (e.g., FIG. 5, 40) of the repair rack.

The method 50 includes withdrawing at least one tool (e.g., FIG. 1, 33) from a tool storage face (e.g., FIG. 2, 8) along an exterior of the upright column to work on the bicycle, at 54. In an example, the at least one tool is coupled with a cable (e.g., FIG. 2, 26) in the interior (e.g., FIG. 2, 24) of the upright column. The tool storage face, in an example, is recessed from the bicycle at the elevated position, such that a user (e.g., FIG. 7, 47) is able to access the at least one tool at the tool storage face. In an example, withdrawing the at least one tool includes withdrawing the tool with a force greater than a retraction force applied by the retraction mechanism (e.g., FIG. 2, 28). In an example, the retraction force results from a counterweight under the affects of gravity. In an example, withdrawing the at least one tool includes pulling a plurality of tools, wherein each of the plurality of tools is configured to be withdrawn individually from the tool storage face.

The method 50 includes pulling the at least one tool toward the tool storage face, when released by an operator, with a retraction mechanism, such as a counterweight, coupled with the cable, at 56. In an example, pulling the tool toward the tool storage face includes pulling the cable into the upright column, such as by lowering a counterweight coupled with the cable within the upright column. Pulling the tool toward the tool storage face includes, in an example, pulling the cable into one of a plurality of retraction channels (e.g., FIG. 8, 27) within the upright column, each of the plurality of retraction channels includes a cable therein.

In an example, the method includes inflating a tire of a bicycle with an air pump (e.g., FIG. 1, 18) coupled with the upright column. Inflating includes, for example, operating the air pump and pumping air through an air line (e.g., FIG. 3, 34) coupled at one end to the air pump and coupled to a hose fitting (e.g., FIG. 3, 32) at the other end of the air line, wherein the hose fitting is remote from the column base. In an example, the method includes pumping air through the hose fitting and through a hose (e.g., FIG. 3, 20) coupled therewith, wherein the hose is suspended above the column base when it is released by an operator.

In an example, the repair rack extends in a first direction from the upright column and the method includes positioning a second bicycle at a second repair station (e.g., FIG. 6, 45) extending in a second direction, different than the first direction, away from the upright column. Positioning the second bicycle includes, for example, receiving a wheel of the second bicycle in a wheel chock (e.g., FIG. 6, 46) near the column base of the upright column, wherein the second bicycle is positioned lower than the bicycle at the elevated position. In an example, the method includes absorbing tool strikes of the tool during pulling of the tool with a tool shield (e.g., FIG. 1, 31) extending along a portion of the tool storage face.

VARIOUS NOTES & EXAMPLES

Example 1 can include a bicycle repair stand comprising: an upright column including a plurality of column faces; a first repair station including a repair rack extending from the upright column in a first direction, the repair rack configured to retain a bicycle at an elevated position relative to a column base; at least one of the plurality of column faces is a tool storage face directed in a second direction different than the first direction; and at least one retractable tool coupled along the tool storage face, the retractable tool includes: a tool, a cable coupled with the tool, and a retraction mechanism coupled with the cable and configured to pull the tool toward the tool storage face when released by an operator.

Example 2 can include, or can optionally be combined with the subject matter of Example 1, to optionally include wherein the repair rack extends from the upright column at a corner of a column face and the tool storage face of the plurality of column faces.

Example 3 can include, or can optionally be combined with the subject matter of one or any combination of Examples 1 or 2 to optionally include wherein the repair rack includes: at least one rod, and a rack fitting coupled with the at least one rod, the rack fitting includes a bicycle support recess configured to provide surface-to-surface contact between the rack fitting and a bicycle frame.

Example 4 can include, or can optionally be combined with the subject matter of one or any combination of Examples 1 through 3 to optionally include an air pump assembly configured to inflate a bicycle tire, the air pump assembly including: an air pump coupled with the upright column, an air line extending from the pump near the column base, the air line extending along the upright column to a hose fitting remote from the column base, and a hose extending from the hose fitting, the hose is suspended above the column base when released by an operator.

Example 5 can include, or can optionally be combined with the subject matter of one or any combination of Examples 1-4 to optionally include wherein the upright column includes a second repair station extending in a third direction different than the first direction, the second repair station configured to retain a bicycle at a second position different than the elevated position.

Example 6 can include, or can optionally be combined with the subject matter of Examples 1-5 to optionally include wherein the second repair station includes a wheel chock sized and shaped to receive a wheel of a bicycle and retain the bicycle in an upright orientation at the second position.

Example 7 can include, or can optionally be combined with the subject matter of Examples 1-6 to optionally include wherein each of the plurality of column faces extends in a direction different than the first direction the repair rack extends.

Example 8 can include, or can optionally be combined with the subject matter of Examples 1-7 to optionally include wherein the tool storage face extends from a corner of the upright column having the repair rack, and the tool storage face is recessed from a bicycle at the elevated position on the repair rack.

Example 9 can include, or can optionally be combined with the subject matter of Examples 1-8 to optionally include wherein the retraction mechanism includes a counterweight coupled with the cable, the counterweight within the upright column and configured to pull the tool toward the storage face while the counterweight descends within the upright column.

Example 10 can include, or can optionally be combined with the subject matter of Examples 1-9 to optionally include a bicycle repair stand comprising: an upright column; a first repair station including a repair rack extending from the upright column, the repair rack configured to retain a bicycle at an elevated position relative to a column base; a tool storage face along an exterior of the upright column; and a plurality of retractable tools coupled along the tool storage face, each of the plurality of retractable tools includes: a tool, a cable coupled with the tool, and a retraction mechanism coupled with the cable and configured to pull the tool and the cable toward the tool storage face when released by an operator.

Example 11 can include, or can optionally be combined with the subject matter of Examples 1-10 to optionally include wherein the tool storage face includes a tool shield extending along at least a portion of the tool storage face, the tool shield configured to protect the upright column from damage caused by tools striking the column.

Example 12 can include, or can optionally be combined with the subject matter of Examples 1-11 to optionally include wherein the tool shield extends along at least two column faces of the upright column facing a bicycle at the elevated position, one of the at least two column faces includes the tool storage face.

Example 13 can include, or can optionally be combined with the subject matter of Examples 1-12 to optionally include wherein the retraction mechanism includes a counterweight coupled with the cable, the counterweight within the upright column and configured to pull the tool toward the storage face while the counterweight descends within the upright column.

Example 14 can include, or can optionally be combined with the subject matter of Examples 1-13 to optionally include wherein the retraction mechanism includes a counterweight having a tapered shape at one or more of a lower end and an upper end of the counterweight.

Example 15 can include, or can optionally be combined with the subject matter of Examples 1-14 to optionally include wherein the upright column includes a plurality of retraction channels, and the retraction mechanism for each of the tools of the plurality of retractable tools is configured pull the cable of each tool into one of the plurality of retraction channels, each of the cables of the plurality of retractable tools isolated relative to each other with the plurality of retraction channels.

Example 16 can include, or can optionally be combined with the subject matter of Examples 1-15 to optionally include wherein the retraction mechanism is configured to pull the tool to an upper end portion of the upright column.

Example 17 can include, or can optionally be combined with the subject matter of Examples 1-16 to optionally include wherein the tool storage face is a column face of the upright column, and extends along an exterior perimeter of the upright column.

Example 18 can include, or can optionally be combined with the subject matter of Examples 1-17 to optionally include wherein the repair rack includes: at least one rod, and a rack fitting coupled with the at least one rod, the rack fitting includes a bicycle support recess configured to provide surface-to-surface contact between the rack fitting and a bicycle frame.

Example 19 can include, or can optionally be combined with the subject matter of Examples 1-18 to optionally include an air pump assembly configured to inflate a bicycle tire, the air pump assembly including: an air pump coupled with the upright column, an air line extending from the pump near the column base, the air line extending along the upright column to a hose fitting remote from the column base, and a hose extending from the hose fitting, the hose is suspended above the column base when released by an operator.

Example 20 can include, or can optionally be combined with the subject matter of Examples 1-19 to optionally include wherein the upright column includes a plurality of column faces including the tool storage face, and each of the plurality of column faces extends in a direction different than a direction the repair rack extends.

Example 21 can include, or can optionally be combined with the subject matter of Examples 1-20 to optionally include a method of using a bicycle repair stand comprising: mounting a bicycle on a repair rack at an elevated position relative to a column base of an upright column coupled with the repair rack; withdrawing at least one tool from a tool storage face along an exterior of the upright column to work on the bicycle, the at least one tool coupled with a cable, and the tool storage face is recessed from the bicycle at the elevated position; and pulling the at least one tool toward the tool storage face when released by an operator with a refraction mechanism coupled with the cable.

Example 22 can include, or can optionally be combined with the subject matter of Examples 1-21 to optionally include wherein mounting the bicycle on the repair rack includes receiving a portion of the bicycle frame within a bicycle support recess of the repair rack.

Example 23 can include, or can optionally be combined with the subject matter of Examples 1-22 to optionally include wherein withdrawing a tool includes withdrawing the tool with a force greater than a retraction force applied by the retraction mechanism.

Example 24 can include, or can optionally be combined with the subject matter of Examples 1-23 to optionally include wherein pulling the tool toward the tool storage face includes pulling the cable into the upright column.

Example 25 can include, or can optionally be combined with the subject matter of Examples 1-24 to optionally include wherein pulling the cable into the upright column includes lowering a counterweight within the upright column, the counterweight is coupled with the cable.

Example 26 can include, or can optionally be combined with the subject matter of Examples 1-25 to optionally include wherein pulling the tool toward the tool storage face includes pulling the cable into one of a plurality of retraction channels within the upright column, each of the plurality of retraction channels includes a cable therein, the cables coupled with respective tools.

Example 27 can include, or can optionally be combined with the subject matter of Examples 1-26 to optionally include wherein withdrawing the at least one tool and pulling the at least one tool includes withdrawing and pulling a plurality of tools, respectively, each of the plurality of tools is configured for individual withdrawal from the tool storage face and pulling toward the tool storage face.

Example 28 can include, or can optionally be combined with the subject matter of Examples 1-27 to optionally include inflating a tire of a bicycle with an air pump coupled with the upright column, inflating including: operating the air pump, pumping air through an air line within the upright column to a hose fitting remote from the column base, and pumping air from the hose fitting to the tire through a hose, the hose is suspended above the column base when released by an operator.

Example 29 can include, or can optionally be combined with the subject matter of Examples 1-28 to optionally include wherein the repair rack extends in a first direction from the upright column, and the method comprises positioning a second bicycle at a second repair station extending in a second direction away from the upright column, the second direction different from the first direction.

Example 30 can include, or can optionally be combined with the subject matter of Examples 1-29 to optionally include wherein positioning the second bicycle includes receiving a wheel of the second bicycle in a wheel chock near the column base of the upright column, the second bicycle positioned lower than the bicycle at the elevated position.

Example 31 can include, or can optionally be combined with the subject matter of Examples 1-30 to optionally include absorbing tool strikes of the tool during pulling of the tool with a tool shield extending along a portion of the tool storage face.

Each of these non-limiting examples can stand on its own, or can be combined in any permutation or combination with any one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A bicycle repair stand, comprising: an upright column including a plurality of column faces that cooperate to define an interior of the column; a first repair station including a repair rack extending from the upright column in a first direction, the repair rack configured to retain a bicycle at an elevated position relative to a column base; wherein at least one of the plurality of column faces is a tool storage face directed in a second direction different than the first direction; and at least one retractable tool coupled along the tool storage face and located exteriorly of the column interior, wherein the retractable tool includes: a tool, a cable coupled with the tool, and a retraction mechanism coupled with the cable and configured to pull the tool toward the tool storage face when the tool is released by an operator, wherein the retraction mechanism comprises a counterweight coupled to the cable, and wherein the counterweight is located within the interior of the column and is movable within the column between a raised position when the tool is moved away from the tool storage face and a lowered position for moving the tool toward the tool storage face.

2. The bicycle repair stand of claim 1, wherein the repair rack extends from the upright column at a corner defined by one of the column faces and the tool storage face.

3. The bicycle repair stand of claim 1, wherein the repair rack includes: at least one rod, and a rack fitting coupled with the at least one rod, wherein the rack fitting includes a bicycle support recess configured to provide surface-to-surface contact between the rack fitting and a bicycle frame.

4. The bicycle repair stand of claim 1, further comprising an air pump assembly configured to inflate a bicycle tire, the air pump assembly including: an air pump coupled with the upright column, an air line extending from the pump near the column base, the air line extending along the upright column to a hose fitting remote from the column base, and a hose extending from the hose fitting, wherein the hose is suspended above the column base when released by an operator.

5. The bicycle repair stand of claim 1, wherein the upright column includes a second repair station extending in a third direction different than the first direction, wherein the second repair station is configured to retain a bicycle at a second position different than the elevated position.

6. The bicycle repair stand of claim 5, wherein the second repair station includes a wheel chock sized and shaped to receive a wheel of a bicycle and retain the bicycle in an upright orientation at the second position.

7. The bicycle repair stand of claim 1, wherein each of the plurality of column faces extends in a direction different than the first direction in which the repair rack extends.

8. The bicycle repair stand of claim 1, wherein the tool storage face extends from a corner of the upright column having the repair rack, and wherein the tool storage face is recessed from a bicycle at the elevated position on the repair rack.

9. A bicycle repair stand, comprising: an upright column defining an interior; a first repair station including a repair rack extending from the upright column, the repair rack configured to retain a bicycle at an elevated position relative to a column base; a tool storage face along an exterior of the upright column; and a plurality of retractable tools coupled along the tool storage face and located exteriorly of the column interior, wherein each of the plurality of retractable tools includes: a tool, a cable coupled with the tool, and a retraction mechanism coupled with the cable and configured to pull the tool and the cable toward the tool storage face when the tool is released by an operator, wherein the retraction mechanism comprises a counterweight coupled to the cable, and wherein the counterweight is located within the interior of the column and is movable within the column between a raised position when the tool is moved away from the tool storage face and a lowered position for moving the tool toward the tool storage face.

10. The bicycle repair stand of claim 9, wherein the tool storage face includes a tool shield extending along at least a portion of the tool storage face, wherein the tool shield is configured to protect the upright column from damage caused by tools striking the column.

11. The bicycle repair stand of claim 10, wherein the tool shield extends along at least two column faces of the upright column facing a bicycle at the elevated position when the bicycle is supported on the repair rack, wherein one of the at least two column faces includes the tool storage face.

12. The bicycle repair stand of claim 9, wherein the counterweight has a tapered shape at one or more of a lower end and an upper end of the counterweight.

13. The bicycle repair stand of claim 9, wherein the upright column includes a plurality of retraction channels, and wherein the retraction mechanism for each of the tools of the plurality of retractable tools is configured to pull the cable of each tool into one of the plurality of retraction channels, wherein the cables of the plurality of retractable tools are isolated from each other with the plurality of retraction channels.

14. The bicycle repair stand of claim 9, wherein the retraction mechanism is configured to pull the tool to an upper end portion of the upright column.

15. The bicycle repair stand of claim 9, wherein the tool storage face is a column face of the upright column, and extends along an exterior perimeter of the upright column.

16. The bicycle repair stand of claim 9, wherein the repair rack includes: at least one rod, and a rack fitting coupled with the at least one rod, wherein the rack fitting includes a bicycle support recess configured to provide surface-to-surface contact between the rack fitting and a bicycle frame.

17. The bicycle repair stand of claim 9, further comprising an air pump assembly configured, to inflate a bicycle tire, the air pump assembly including: an air pump coupled with the upright column, an air line extending from the pump near the column base, the air line extending along the upright column to a hose fitting remote from the column base, and a hose extending from the hose fitting, wherein the hose is suspended above the column base when released by an operator.

18. The bicycle repair stand of claim 9, wherein the upright column includes a plurality of column faces including the tool storage face, and wherein each of the plurality of column faces extends in a direction different than a direction in which the repair rack extends.

19. A method of using a bicycle repair stand, comprising: mounting a bicycle on a repair rack at an elevated position relative to a column base of an upright column coupled with the repair rack, wherein the upright column defines an interior; withdrawing at least one tool from a tool storage face located exteriorly of the column interior along an exterior of the upright column to work on the bicycle, the at least one tool coupled with a cable, and wherein the tool storage face is recessed from the bicycle at the elevated position; and pulling the at least one tool toward the tool storage face when released by an operator with a retraction mechanism coupled with the cable, wherein the retraction mechanism comprises a counterweight coupled to the cable, wherein the counterweight is located within the interior of the column and is movable within the column between a raised position when the tool is moved away from the tool storage face and a lowered position for moving the tool toward the tool storage face.

20. The method of claim 19, wherein mounting the bicycle on the repair rack includes receiving a portion of the bicycle frame within a bicycle support recess of the repair rack.

21. The method of claim 19, wherein withdrawing at least one tool includes withdrawing the tool with a force greater than a retraction force applied by the retraction mechanism.

22. The method of claim 19, wherein pulling the tool toward the tool storage face includes pulling the cable into the upright column.

23. The method of claim 19, wherein withdrawing the at least one tool and pulling the at least one tool includes withdrawing and pulling a plurality of tools, respectively, wherein each of the plurality of tools is coupled with a cable, and wherein each tool and the cable with which it is coupled is configured for individual withdrawal from the tool storage face and pulling toward the tool storage face.

24. The method of claim 23, wherein pulling each tool toward the tool storage face includes pulling the cable with which the tool is coupled into one of a plurality of retraction channels within the upright column, wherein each of the plurality of retraction channels includes one of the cables therein.

25. The method of claim 19 further comprising inflating a tire of a bicycle with an air pump coupled with the upright column, wherein inflating includes: operating the air pump, pumping air through an air line within the upright column to a hose fitting remote from the column base, and pumping air from the hose fitting to the tire through a hose, wherein the hose is suspended above the column base when released by an operator.

26. The method of claim 19, wherein the repair rack extends in a first direction from the upright column, and the method comprises positioning a second bicycle at a second repair station extending in a second direction away from the upright column, wherein the second direction is different from the first direction.

27. The method of claim 26, wherein positioning the second bicycle includes receiving a wheel of the second bicycle in a wheel chock near the column base of the upright column, wherein the second bicycle is positioned lower than the bicycle at the elevated position.

28. The method of claim 19 further comprising absorbing tool strikes of the tool during pulling of the tool with a tool shield extending along a portion of the tool storage face.

* * * * *